US005539169A

United States Patent [19]

Sekita

[11] Patent Number: 5,539,169

[45] Date of Patent: Jul. 23, 1996

[54] LOCKING MECHANISM FOR PUSH-PUSH SWITCH

[75] Inventor: Youichi Sekita, Saitama, Japan

[73] Assignee: Toyodenso Kabushiki Kaisha, Tokyo, Japan

[21] Appl. No.: 366,508

[22] Filed: Dec. 30, 1994

[30] Foreign Application Priority Data

Dec. 31, 1993 [JP] Japan ..... 5-075766 U

[51] Int. Cl.[6] ..... H01H 3/42

[52] U.S. Cl. ..... 200/524; 200/531

[58] Field of Search ..... 200/524, 523, 200/531

[56] References Cited

U.S. PATENT DOCUMENTS

| | | | |
|---|---|---|---|
| 3,288,973 | 11/1966 | Piber . | |
| 3,624,328 | 11/1971 | Hansen | 200/531 X |
| 3,697,713 | 10/1972 | Ohkita . | |
| 4,636,601 | 1/1987 | Tanabe . | |
| 4,677,267 | 6/1987 | Oba . | |
| 4,827,087 | 5/1989 | Niinuma et al. . | |
| 4,870,229 | 9/1989 | Kawase et al. . | |
| 4,891,475 | 1/1990 | Wiersing et al. | 200/524 X |
| 4,937,409 | 6/1990 | Hayashi . | |
| 4,956,529 | 9/1990 | Ueno . | |
| 5,187,335 | 2/1993 | Fukuyama et al. . | |

FOREIGN PATENT DOCUMENTS

| | | | |
|---|---|---|---|
| 55-104216 | 1/1979 | Japan . | |
| 61-44352 | 1/1983 | Japan . | |
| 1-129733 | 2/1988 | Japan . | |
| 1336016 | 11/1973 | United Kingdom | 200/524 |

*Primary Examiner*—Renee S. Luebke
*Attorney, Agent, or Firm*—Birch, Stewart, Kolasch & Birch

[57] ABSTRACT

A switch case 10 is provided with a heart-shaped cam groove member 15 having a cam groove 16 and there is inserted a return spring between the switch case 10 and a contact holder 30. The contact holder 30 is provided with a lock pin 60 having the top end 64 thereof engaged with the cam groove 16. The lock pin 60 has a curved portion 61 adapted to be pressed by a portion of a contact plate 50, wherein the top end 64 of the curved portion 61 is held into engagement with the cam groove 16. As a result, an extra space for the cam groove, 16 is not needed any more on the side of the contact holder 30, contributing to miniaturization of the whole switch assembly. Further since the lock pin 60 is pressed by means of the contact plate 50, it is unnecessary to have an exclusive return spring provided therein.

6 Claims, 7 Drawing Sheets

LOCKING MECHANISM FOR PUSH-PUSH SWITCH

BACKGROUND OF THE INVENTION

1. Field of the Invention

The present invention relates to a locking mechanism for a push-push switch.

2. Description of Background Art

A push-push switch is generally known which comprises a heart-shaped cam groove and may repeatedly be opened or closed by pressing a knob. For example, a push-push switch disclosed in Japanese Utility Model Publication No. Sho. 61-44352 comprises a heart-shaped cam groove provided on the side of a contact holder adapted to be moved by a knob, and a lock pin supported on the side of a switch case and arranged to engage the contact holder, the lock pin being biased in the direction of engagement with the heart-shaped cam groove by a return spring of the contact holder.

In the foregoing example of a conventional structure, because the heart-shaped cam groove is provided on the side of the movable contact holder, the latter must be large. Thus, there is a drawback that the contact holder needs an extra space and a switch assembly may also be large.

Also when the lock pin is biased by means of the return spring of the contact holder for engagement with the heart-shaped cam groove, the number of parts may be reduced, but there is the possibility that the heart-shaped cam groove may be deformed by a hard abutment with the lock pin because a considerably strong spring is used therein. On the contrary, if a weak spring is used, it becomes unstable to operate the contact holder. It is therefore quite difficult to maintain the well-balanced strength of the spring.

SUMMARY OF THE INVENTION

In order to solve the drawback described above, according to the present invention, there is provided a locking mechanism for a push-push switch comprising a heart-shaped cam groove and a lock pin adapted to engage with the heart-shaped cam groove, said lock pin being provided at its one end with a rockably supported rocking end portion and at its other end with an engaging end adapted to engage with said heart-shaped cam groove, and said heart-shaped cam groove being provided on the side of a switch case, wherein an elastic contact plate has two ends, one for slidably contacting a stationary contact of the switch case and the other for pressing the lock pin, thereby urging the latter to allow the engaging end thereof to engage with the heart-shaped cam groove.

Also the contact plate may be formed by folding a leaf spring in a forked-shape manner, while the lock pin may be provided with a curved portion to be depressed by the contact plate.

A contact holder may also be provided with a lock pin supporting portion for rockably supporting the rocking end portion of the lock pin and a contact plate supporting portion for supporting the contact plate, both supporting portions being integrally formed with the contact holder.

In such a case, the lock pin supporting portion comprises a supporting base for supporting the curved portion of the lock pin on a plane and a rocking clearance formed between the supporting base for the curved portion and the contact plate supporting portion. Also the supporting base for the curved portion is provided with a projection integrally formed therewith which projects into the rocking clearance and which may also serve as a pivoting fulcrum for supporting the rocking end portion of the lock pin.

On the other hand, the rocking end portion of the lock pin is made straight, while the lock pin supporting portion may be a recess formed in the contact holder and having substantially the same inner diameter as the outer diameter of the rocking end portion.

Also the contact holder may be formed with a recess for accommodating a return spring therein.

According to the present invention the heart-shaped cam groove is rigidly secured on the side of the switch case to make the entire switch assembly small and the lock pin is depressed by the contact plate so that it can be urged toward the heart-shaped cam groove by means of the spring force of the contact plate. Thus the parts can be effectively used herein. Also because the return spring of the contact holder is not used for depressing the lock pin, it is not necessary to adjust the balance between the spring force to the, lock pin and the spring force of the return spring of the contact holder.

Also because the lock pin is depressed at its curved portion and the reactive force from the lock pin is not applied direct to the contact plate, it is possible to improve the endurance of the contact plate. Also because the contact holder is provided with the lock pin supporting portion integrally formed therewith, it is further possible to reduce the number of parts.

Since the lock pin is first mounted on the supporting portion for the curved portion and the contact plate is then mounted on the lock pin, it is not only possible to simplify the, structure, but also easily assemble the switch and improve the operativity.

Further, it is possible to make the rocking movement of the lock pin smoother by rockably supporting the lock pin at the pivoting fulcrum. 0n the other hand, when the lock pin is supported to move only in the axial direction of the rocking end portion of the lock pin which is linearly formed, it is possible to direct the reactive force from the lock pin to the contact plate to a predetermined direction.

Still further, if the contact holder is provided with the recess integrally formed therewith for accommodating the return spring therein, it is possible to wither reduce the number of the parts and miniaturize the switch assembly.

The above and other objects, features and advantages of the present invention will become apparent from the following description and the appended claims, taken in conjunction with the accompanying drawings.

DETAILED DESCRIPTION OF THE PREFERRED EMBODIMENTS

Figure 1:
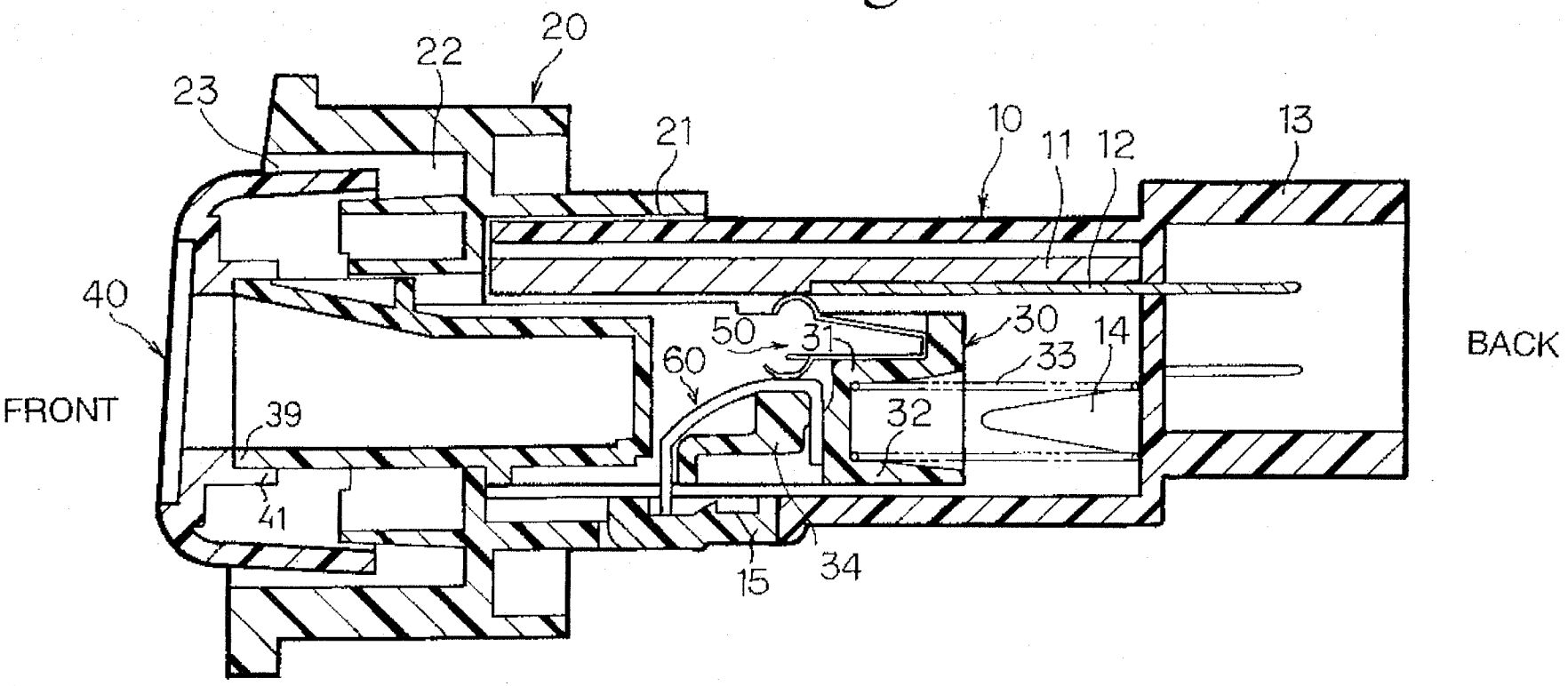
FIG. 1 is a whole sectional view of an embodiment in accordance with the present invention.

An embodiment of the present invention is hereinafter described in detail with reference to the drawings attached hereto. Referring first to FIG. 1, there is shown a whole sectional view of a push-push switch according to the present embodiment. The switch includes a switch case 10, a case front portion 20, a contact holder 30 and a knob 40. The contact holder 30 is arranged to support a contact plate 50 and a lock pin 60 thereon.

The switch case 10 is composed of a circuit board 11, a terminal 12 and a coupler portion 13 which are integrally formed with each other, wherein the terminal 12 is connected at its one end to the circuit board and extends at its other end into the coupler portion 13 (the side of the knob 40 is hereinafter referred to as the front and the side of the coupler portion 13 is referred to the back, respectively).

Also a projection 14 is formed at a wall surface facing the contact holder 30 near the coupler portion 13 and a heart-shaped cam groove member 15 is additionally incorporated below the lock pin 60.

The switch case 10 has one end inserted into a cylindrical portion 21 of the case front portion 20. The case front portion 20 is formed at its front side with an opening portion 23 having a space 22 for accommodating the knob 40.

A cylindrical portion 41 is provided to project inside of the knob 40 and an end portion 39 of the contact holder 30 is arranged to engage with the cylindrical portion 41 so that the knob 40 and the contact holder 30 can be moved together.

The contact holder 30 is provided at its rear end side with a stepped portion 31 for supporting the contact plate 50 and at its lower side with a spring accommodation hole 32 in which one end of a return spring for the contact holder 30 is secured and the other end thereof is supported by a projection 14.

Figure 2:
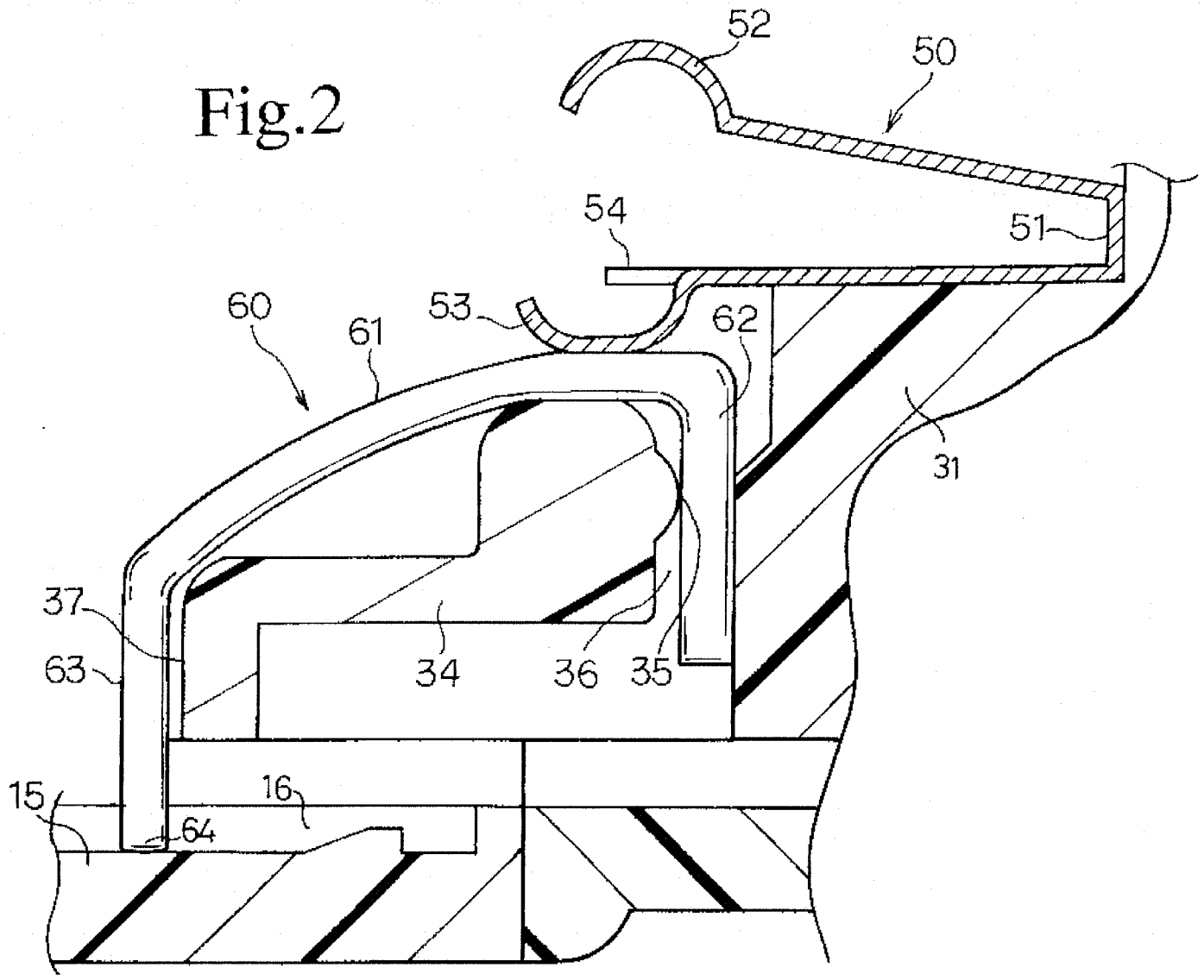
FIG. 2 is an enlarged sectional view near a contact holder of the embodiment.

As will be apparent from FIG. 2 which shows an enlarged sectional view of the contact plate 50 and the lock pin 60, the contact holder 30 is also provided with a supporting base 34 in front of the stepped portion 31 and the lock pin 60 assuming a generally C-shaped configuration has a curved portion 61 which is supported on the supporting base 34. A straight portion 62 of the lock pin 60 extending from the curved portion 61 is now inserted in a clearance 36 formed between the stepped portion 31 and the supporting base 34 of the contact holder 30 and pivotally supported by a projection 35 serving as a fulcrum.

Also a straight portion 63 bent downwardly from the other end of the curved portion 61 is arranged to extend downwardly through a clearance 37 formed on the front side of the supporting base 34 and a top end 64 of the straight portion 63 now engages the inside of a cam groove 16 of the heart-shaped cam groove member 15.

As shown in FIGS. 4–8, the heart-shaped cam groove member 15 is a separate member formed with known cam groove 16 and it is provided at its periphery with attachment portions 17. The heart-shaped cam groove member 15 is secured to the side of the switch case 10 by engagement of the attachment portions 17 with the latter.

Figure 3:
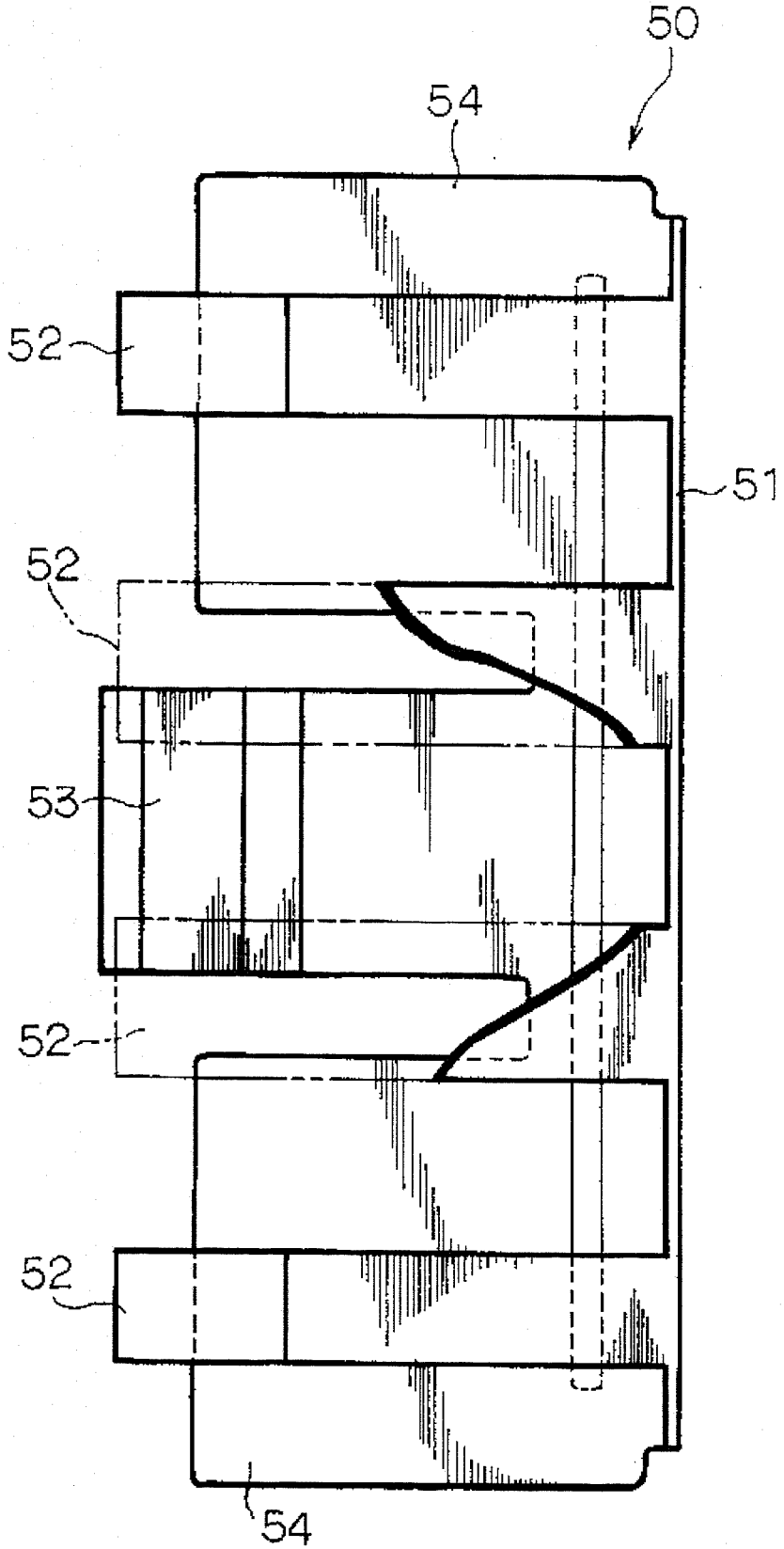
FIG. 3 is a partially cutaway plan view of the contact plate of the embodiment.
Figure 4:
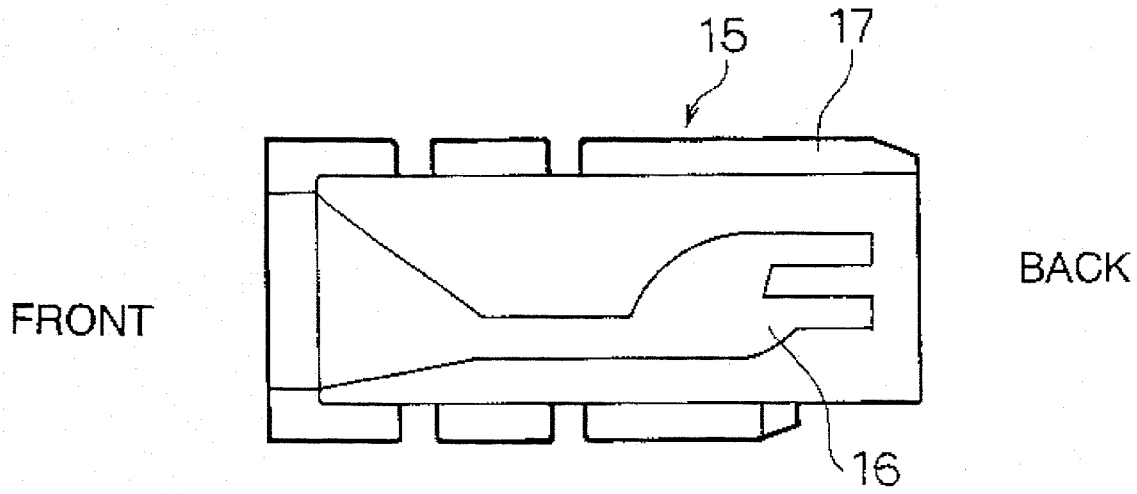
FIG. 4 is an enlarged plan view of a heart-shaped cam groove.
Figure 5:
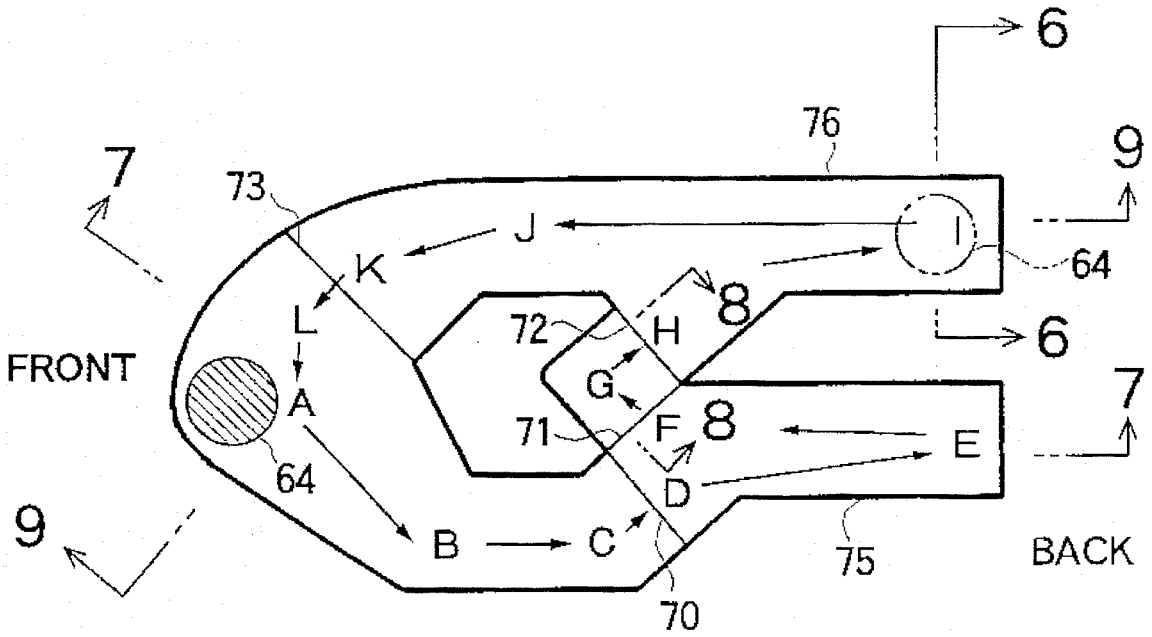
FIG. 5 is an enlarged plan view of the cam groove explaining movement of an end portion of a lock pin.
Figure 6:
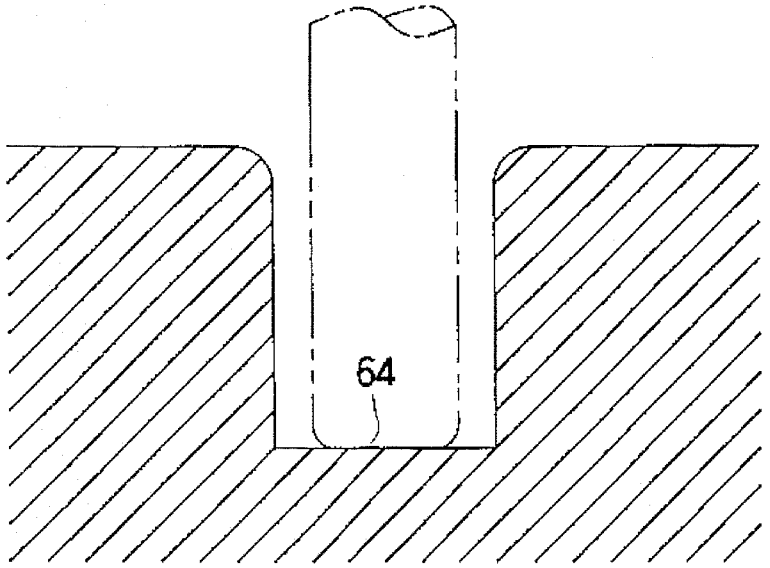
FIG. 6 is a sectional view taken along the line 6—6 of FIG. 5.
Figure 7:
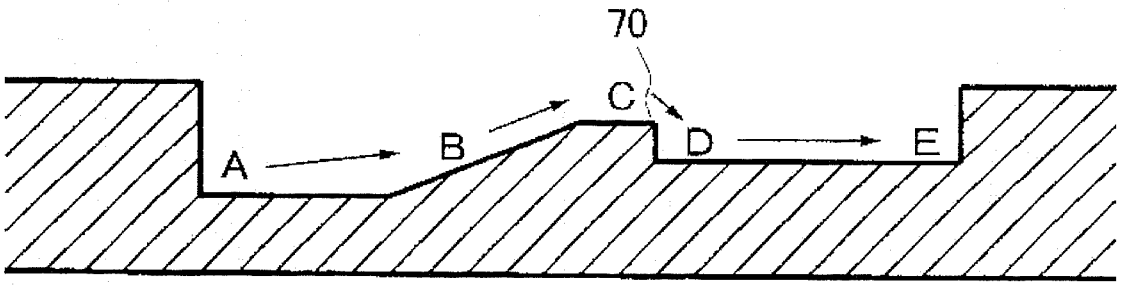
FIG. 7 is a sectional view taken along the line 7—7 of FIG. 5.
Figure 8:
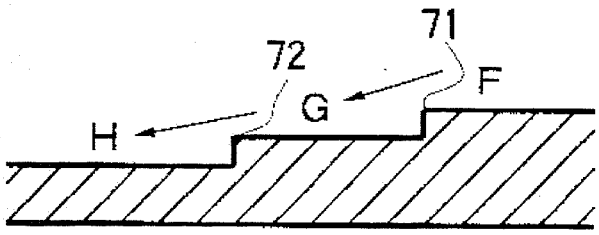
FIG. 8 is a sectional view taken along the line 8—8 of FIG. 5.

As shown in FIG. 2 and FIG. 3 (which shows a partially cutaway plan view of FIG. 2), The contact plate 50 is formed by folding a leaf spring in two at a folding portion 51, wherein one end 52 thereof is arranged to slidably contact the circuit board 11 (see FIG. 1 ) and the other side is composed of a substantially horizontally extending attachment portion 54 and a curved pressing portion 53 bent downwardly and adapted to press the curved portion 61 of the lock pin 60.

Now, the movement of the top end 64 of the lock pin 60 on the cam groove 16 will be described with reference to FIGS. 5 through 9. When the knob 40 is not pressed, the top end 64 lies at a starting position A, because one end 52 of the contact plate 50 is in the non-contacting position with the terminal 12, the circuit is maintained in its open condition.

When the knob 40 is depressed against the force of the return spring 33 and the top end 64 is moved toward the back of the drawings together with the contact holder 30, the top end 64 moves up along an inclined surface B of the cam groove 16 and reaches the top position C. After this, the top end 64 falls downwardly at a step 70 to arrive at a position D and it moves to enter the dead end groove 75 and stops at a terminal position E(see FIG. 7).

Thereafter, when the knob 4,:) is released, the top end 64 is pushed back toward the front by the elastic force of the return spring 33 and it moves from the terminal position E to a position F. Further, the top end 64 moves from the position F to fall at a step 71 to arrive at a stop position G. It stably stops at the stop position G (see FIG. 8). For this purpose, the contact holder 30 is locked and the top end 52 of the contact plate 50 contacts the terminal 12 to maintain the circuit in its closed condition.

Figure 9:
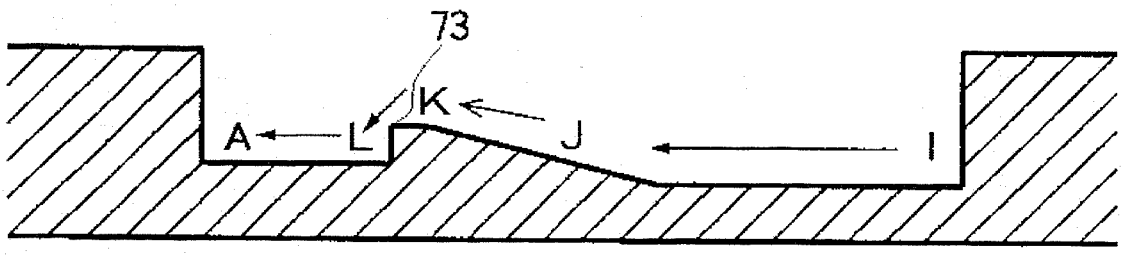
FIG. 9 is a sectional view taken along the line 9—9 of FIG. 5.

Then, when the knob 40 is depressed again, because the top end 64 moves from the stop position G toward the back of the drawings, the top end 64 moves from the position G and falls at a step 72 to arrive at a position H. It then enters another dead end groove 76 parallel to the dead end groove 75 and stops at a terminal position I. In this condition, when the knob 40 is released, the top end 64 is moved toward the front by the elastic force of the return spring 33. As shown in FIG. 9, the top end 64 moves from the terminal position I and moves up along an inclined surface J of the cam groove 16 and reaches the top position K. It moves to fall at a step 73 to arrive at a position L. It moves from the position L and returns to its starting position A, where it stably stops.

Now, the operation of the present embodiment will be described. As is apparent in FIGS. 1 and 2, when the knob 40 is depressed, the top end 64 of the lock pin 60 engages the cam groove 16 of the heart-shaped cam groove member 15 so as to maintain the contact holder 30 in the locking or unlocking condition against the switch case 10. In this case, sure engagement of the top end 64 with the cam groove 16 is attained because the curved portion 61 is depressed by the curved pressing portion 53.

Also since the curved pressing portion 53 presses the curved portion 61, the reactive force from the curved portion 61 to the curved pressing portion 53 is not transmitted direct to the contact plate 50 and as a result, the endurance of the contact plate 50 can be improved.

Further, since the lock pin 60 is first mounted on the supporting base 34 and then the contact plate 50 is simply set on the stepped portion 31, it is possible to make the assembly as well as the structure simpler and improve the operativity.

Still further, since the return spring 33 for the contact holder 30 is not used like the conventional push-push switch, it is no longer necessary to balance the spring force in relation to the operative feeling and it is possible to make the design easier.

Since the heart-shaped cam groove member 15 is secured on the side of the switch case 10, it is no longer necessary to provide a comparatively large space on the side of the contact holder 30 as seen in the prior art and as a result, it is not only possible to miniaturize the contact holder 30, but also to miniaturize the whole switch assembly.

Figure 10:
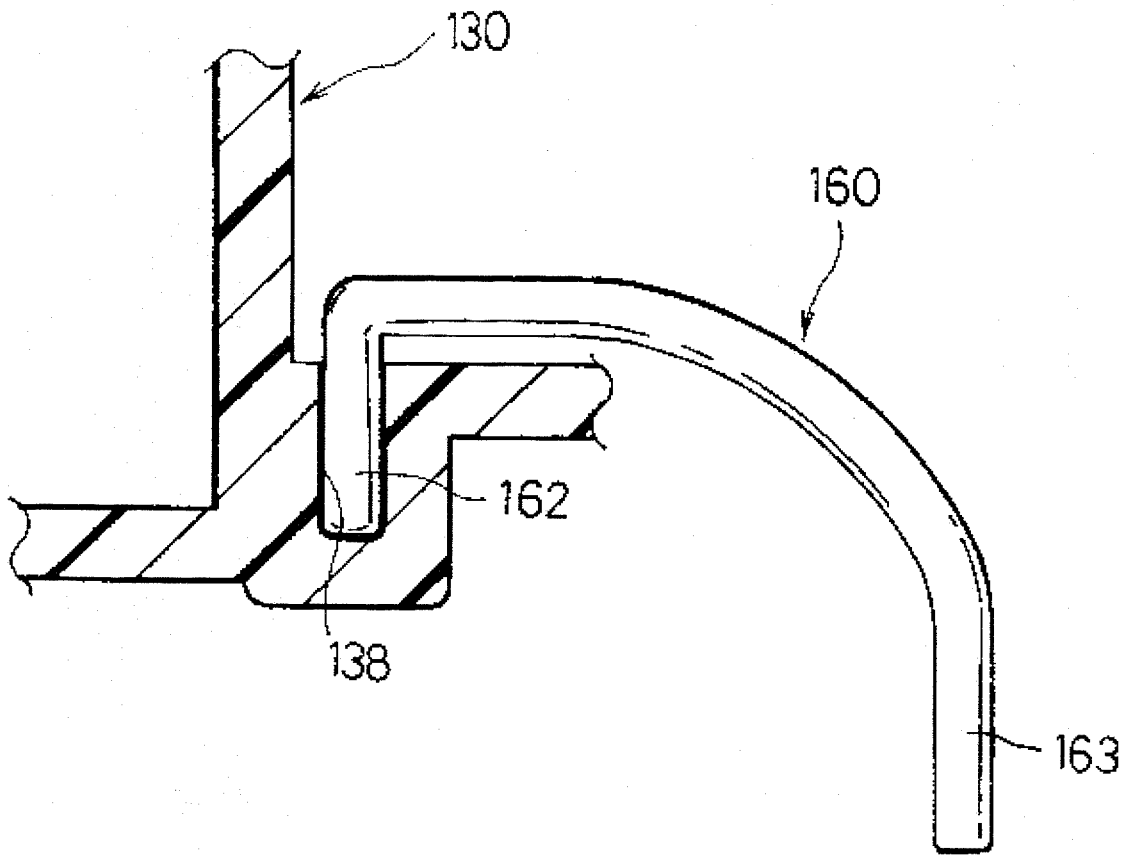
FIG. 10 is an enlarged sectional view of a major part showing an attachment structure of the lock pin of another embodiment.

FIG. 10 is an another embodiment showing the attachment of the lock pin in which the front and the back of the lock pin is set in the opposite direction to that of FIG. 2. A straight portion 162 of a lock pin 160 is engageably inserted into a recess 138 preformed on the side of a contact holder 130. The recess 138 is designed to have almost the same inner diameter as the outer diameter of the straight portion 162 and it is formed parallel to the other straight portion 163.

With this, the lock pin 160 is urged to move only in the axial direction of the straight portion 162 and it is possible to direct the reactive force in the predetermined direction.

Having now fully described the invention, it will be apparent to one of ordinary skill in the art that many changes and modifications can be made thereto without departing from the spirit and scope of the invention as set forth herein.

What we claimed is:

1. A locking mechanism for a push-push switch comprising:

a heart-shaped cam groove; and a lock pin adapted to engage with the heart-shaped cam groove;

said lock pin being provided at a first end with a rockably supported rocking end portion and at a second end with an engaging end adapted to engage with said heart-shaped cam groove; and said heart-shaped cam groove being provided on the side of a switch case;

wherein an elastic contact plate has two ends, one for slidably contacting a stationary contact of the switch case and the other for pressing the lock pin, thereby urging the latter to allow the engaging end thereof to engage with the heart-shaped cam groove, said contact plate being formed by folding an elastic material in a fork-shaped manner and each free end thereof is elastically deformable for further expansion.

2. The locking mechanism for a push-push switch according to claim 1, wherein a contact holder is provided with a lock pin supporting portion for rockably supporting the rocking end of the lock pin and a contact plate supporting portion for supporting the contact plate, both supporting portions being integrally formed with the contact holder.

3. The locking mechanism for a push-push switch according to claim 2, wherein the rocking end of the lock pin is straight and the lock pin supporting portion is a recess formed in the contact holder and having substantially the same inner diameter as the outer diameter of the rocking end.

4. A locking mechanism for a push-push switch according to claim 2, wherein the contact holder is provided with a recess for accommodating a return spring therein.

5. The locking mechanism for a push-push switch according to claim 2, wherein the lock pin supporting portion comprises a supporting base for supporting a curved portion of the lock pin on a plane and a rocking clearance formed between the supporting base and the contact plate supporting portion.

6. The locking mechanism for a push-push switch according to claim 5, wherein the supporting base for the curved portion is provided with a projection integrally formed therewith which projects into the rocking clearance and which serves as a pivoting fulcrum for supporting the rocking end of the lock pin.

* * * * *